US005511751A

United States Patent [19]

Shen

[11] Patent Number: 5,511,751

[45] Date of Patent: Apr. 30, 1996

[54] STRUCTURE OF A STAND FOR LIQUID VESSELS

[76] Inventor: Hung C. Shen, No.12,Alley Chi Hsiang, Tung Shan Rd., Tsao Tun Town, Nan Tou, Taiwan

[21] Appl. No.: 152,747

[22] Filed: Nov. 16, 1993

[51] Int. Cl.[6] ..... F16M 13/00

[52] U.S. Cl. ..... 248/205.8; 248/363; 248/362; 248/146

[58] Field of Search ..... 248/154, 362, 248/205.8, 500, 510, 363, 146

[56] References Cited

U.S. PATENT DOCUMENTS

| | | | |
|---|---|---|---|
| 1,840,400 | 1/1932 | Lebherz | 248/362 |
| 2,963,256 | 12/1960 | Borah | 248/362 X |
| 3,159,370 | 12/1964 | Rubinstein | 248/362 X |
| 3,904,164 | 9/1975 | Wheeler et al. | 248/362 |
| 4,756,497 | 7/1988 | Lan | 248/311.2 X |
| 4,869,381 | 9/1989 | Agner | 248/363 X |
| 5,065,973 | 11/1991 | Wang | 248/362 |
| 5,102,086 | 4/1992 | Thomason | 248/311.2 |
| 5,180,132 | 1/1993 | Pearson et al. | 248/362 |

FOREIGN PATENT DOCUMENTS

| | | | |
|---|---|---|---|
| 1008093 | 10/1965 | United Kingdom | 248/362 |

*Primary Examiner*—Karen J. Chotkowski
*Attorney, Agent, or Firm*—Morton J. Rosenberg; David I. Klein

[57] ABSTRACT

A structure of a stand for liquid vessels is provided. The stand has an elastic bottom surface having a central portion which is displaceable by means of a lift apparatus to form a base with vacuum securement between the bottom surface and a base surface. The lift apparatus raises the central portion of the bottom surface of the base to form a suction holding force. A receiving cylinder controls positions and operations of the base and the lift apparatus. A support cylinder connects to the receiving cylinder. The configuration of the support cylinder may be adapted to fit various kinds of liquid vessels.

1 Claim, 2 Drawing Sheets

STRUCTURE OF A STAND FOR LIQUID VESSELS

BACKGROUND OF THE INVENTION

1. Field of the Invention

The present invention relates to a structure of a stand for liquid vessels. In particular, the present invention is related to such a stand for small liquid vessels to prevent them from being knocked over.

2. Prior Art

The liquid vessels regularly used by persons on a daily basis, for example, glasses, cans and bottles, lack any means to be releasably secured to a base surface on which they are placed. Liquid vessels without such means, are prone to being knocked down, as by bumping, due to negligence of children, pets and even adults. The liquid in the vessels will then flow out, soil the surrounding area as well as other articles, grounds or carpets. The vessels themselves may also be broken when knocked over.

SUMMARY OF THE INVENTION

The main object of the present invention is to overcome the disadvantages discussed above.

Preferably, the invention provides a stand for liquid vessels suitable for being releasably fixed by suction to a smooth and glossy surface with the liquid vessels being put in a support cylinder to prevent the combination from being knocked over.

DETAILED DESCRIPTION OF THE PREFERRED EMBODIMENT

Figure 1:
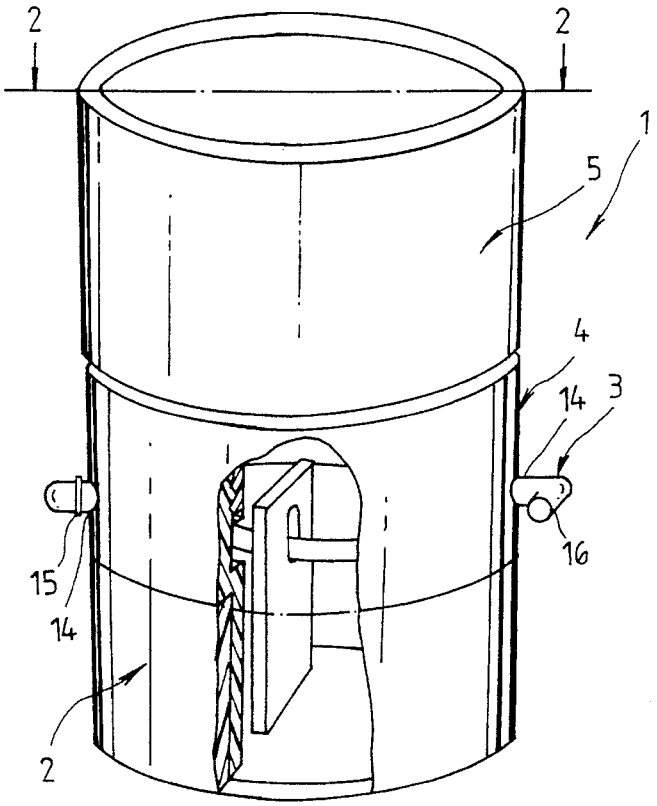
FIG. 1 is a perspective view, partially sectioned, of the present invention.
Figure 2:
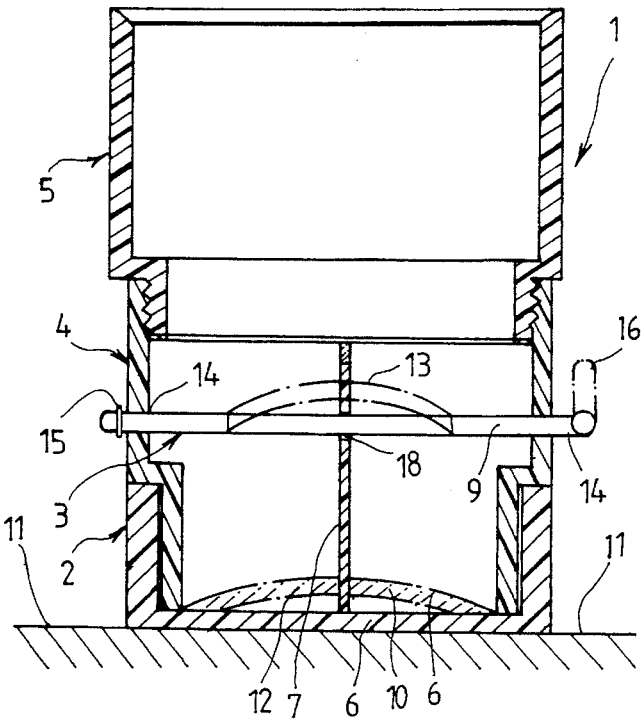
FIG. 2 is a cross-sectional elevation view of the present invention taken along the Section Line 2—2 of FIG. 1.

Referring now to FIGS. 1 and 2, there is shown a stand for liquid vessels 1 comprising an elastic base 2, a lift apparatus 3, a receiving cylinder 4 and a support cylinder 5. The elastic base 2 is made of latex or similar materials to form a cylinder with a sealed bottom and a depressed center. The top of the elastic base 2 is connected to the received cylinder 4. The external margin of a bottom surface 6 is smooth and glossy. The internal center of the bottom surface 6 is coupled to a stiff lift plank 7 of the lift apparatus 3. The lift plank 7 is formed with a lift bore 18 at the upper end thereof, through which a lift stick 9 passes. The lift stick 9 lifts the lift plank to pull the center of the bottom surface 6 upward, as shown in FIG. 2. A vacuum space 12 is formed between the raised portion 10 on the bottom margin of the bottom surface 6 and the base surface 11 over which the stand is located, providing a suction force for securement to the surface 11. The lift stick 9 of the lift apparatus 3 has a circular cross-section with a bent portion 13 disposed intermediate opposing ends thereof. Both ends of the lift stick 9 are respectively connected at a suitable height through the cylinder wall of the receiving cylinder 4, coupled to the receiving cylinder 4 through the bores 14. The bores 14 correspond in height to the lift bore 18 of the lift plank 7. A circular groove is formed on the linear end of lift stick 9 to receive a C-shaped clip ring 15. The other end of lift stick 9 is folded and bent to form a handle 16, the bent portion being turned by a user's hand to lift the bottom surface 6.

Figure 3:
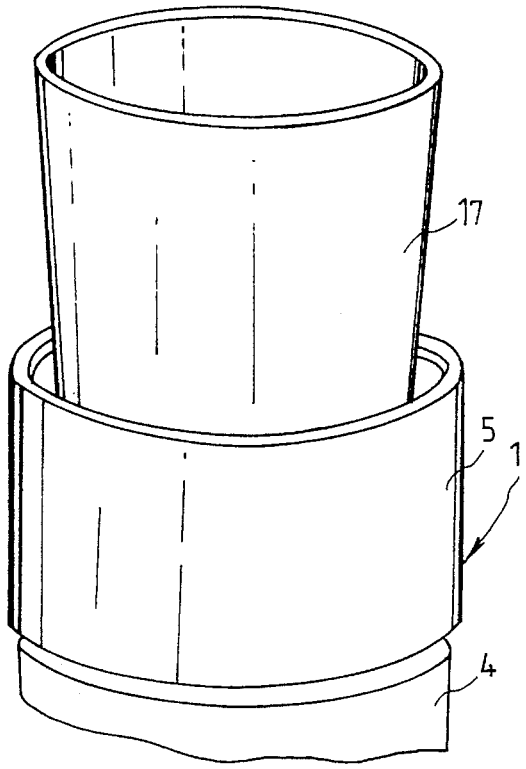
FIG. 3 is a partial elevational view of the present invention showing a glass being supported.
Figure 5:
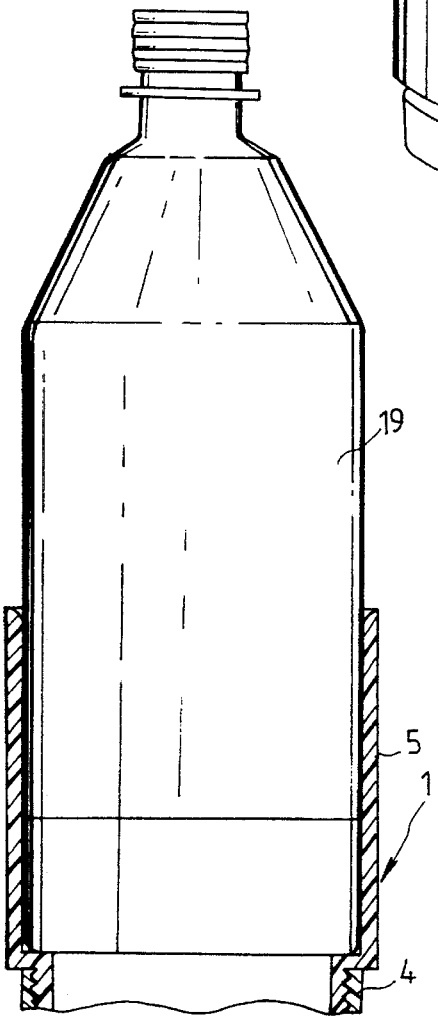
Figure 4:
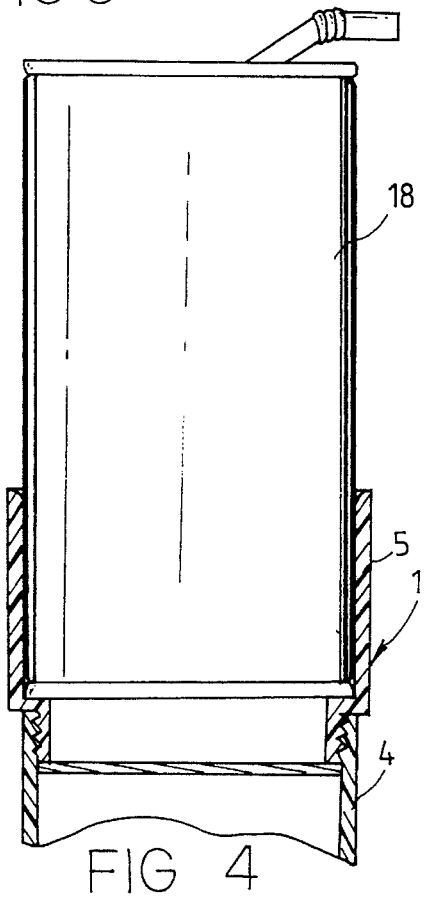
FIG. 4 is a partial cross-sectional view of the present invention showing a beverage can being supported; and, FIG. 5 is a partial cross-sectional view of the present invention showing a bottle being supported.

As shown in FIGS. 1 and 2, the receiving cylinder 4 is a stiff cylinder with openings on both ends. The bottom end connects with said elastic base 2 about the perimeter thereof and by means of the lift stick 9 passing through the lift bore 18 of the lift plank 7. The top end is formed with an internal screw thread to threadedly couple a suitable support cylinder 5 thereto. The bores 14 are installed at the relative height of the lift bore 18, the cylinder body of the receiving cylinder 4 being rotatably coupled to the lift stick 9 through the bores 14. The receiving cylinder 4 is screwed to the support cylinder 5, the support cylinder 5 being on top of the receiving cylinder 4. The support cylinder 5 may be shaped differently to adapt to glasses 17, cans 18 or bottles 19 (as shown in FIGS. 3–5), whereby users choose one with a suitable configuration.

In use, this invention only needs a suitable support cylinder 5 selected to receive the type of vessels which are intended to be used. The support cylinder 5 is screwed on to the top end of the receiving cylinder 4, the elastic base 2 being put on a smooth and glossy surface 11 (as shown in FIG. 2). The lift stick 9 is rotated to pull the bottom surface base 6 upward, creating a suction force to hold the stand for liquid vessels 1 on the smooth and glossy surface 11. Liquid vessels (glasses 17, cans 18 and bottles 19, etc.) may then be placed in the support cylinder (as shown in FIGS. 3–5) to prevent them from being knocked over.

I claim:

1. A structure of a stand for supporting liquid holding vessels on a base surface, comprising:

a support cylinder having an longitudinally directed bore extending from a closed bottom end to an open upper end for receiving the liquid holding vessels therein, said support cylinder having screw threads formed on an external surface thereof adjacent said closed bottom end;

a receiving cylinder formed by a longitudinally extended substantially rigid first tubular wall member coupled to said support cylinder, said first tubular wall member defining a longitudinally directed through bore extending between opposing open upper and lower ends of said receiving cylinder, said receiving cylinder having screw threads formed on an internal surface of said first tubular wall member adjacent said upper end thereof for threaded engagement with said screw threads of said support cylinder;

an elastic base formed of a pliant material and having an upper end coupled to said lower end of said receiving cylinder, said elastic base having a cylindrical contour defined by a second tubular wall member having an open upper end, and an end wall member integrally formed at a lower end of said second tubular wall member, said end wall member having opposing internal and external surfaces, said elastic base being coupled to said receiving cylinder by engagement of an external surface of said first tubular wall member adjacent said lower end of said receiving cylinder by an internal surface of second tubular wall member; and, means for lifting a central portion of said end wall member disposed within said receiving cylinder, said lifting means including (1) a lift plank member having one end coupled to said central portion of said end wall member and a through opening formed in an opposing end thereof, and (2) a lifting shaft rotatably coupled to said receiving cylinder, said lifting shaft having an arcuate central portion coupled to said lift plank member through said through opening formed therein and a pair of linearly directed end portions passing through respective through bores formed in opposing sides of said first tubular wall member, whereby rotation of said lifting shaft raises said lift plank and thereby lifts said central portion of said end wall member while a perimeter portion of said end wall member remains in contiguous contact with the base surface for creating a suction force between said external surface of said end wall member and the base surface.

* * * * *